United States Patent [19]

Ito et al.

[11] 4,087,235

[45] May 2, 1978

[54] APPARATUS FOR INCINERATING WASTE GASES

[75] Inventors: Takusen Ito; Kenji Onose, both of Osaka, Japan

[73] Assignee: Hitachi Shipbuilding & Engineering Co., Ltd., Osaka, Japan

[21] Appl. No.: 738,927

[22] Filed: Nov. 4, 1976

[30] Foreign Application Priority Data

Apr. 9, 1976 Japan ..... 51-44874[U]

[51] Int. Cl.[2] ..... F23C 5/28

[52] U.S. Cl. ..... 431/174; 431/5; 431/202

[58] Field of Search ..... 431/202, 5, 174, 175, 431/179, 180, 285; 23/277 C; 110/8 A

[56] References Cited

U.S. PATENT DOCUMENTS

| | | | |
|---|---|---|---|
| 3,703,349 | 11/1972 | Straitz | 431/202 |
| 3,754,869 | 8/1973 | Raden | 23/277 C |
| 3,933,420 | 1/1976 | Zink et al. | 431/202 |
| 3,985,494 | 10/1976 | Childree | 431/175 |

*Primary Examiner*—Edward G. Favors

*Attorney, Agent, or Firm*—Allison C. Collard

[57] ABSTRACT

An apparatus for incinerating a waste gas comprises a combustion furnace main body having a peripheral wall and a hearth and a plurality of flare burners disposed on the hearth. Each of the flare burners includes a burner main body having a peripheral wall and a bottom wall, a waste gas main pipe provided under the burner main body, water gas branch pipes extending upward from the waste gas main pipe and each having a vertical zigzag passage in an intermediate portion thereof, gas nozzles mounted in the upper ends of the waste gas branch pipes respectively and positioned inside the peripheral wall of the burner main body, a steam main pipe extending through the waste gas main pipe and projecting upward through the bottom wall of the burner main body, steam branch pipes extending upward from the steam main pipe, and steam nozzles mounted on the upper ends of the steam branch pipes respectively and positioned close to the gas nozzles. When the waste gas forced out from the gas nozzles is ignited and burned, the free carbon in the flame and the steam forced out from the steam nozzles undergo water gas reaction, permitting the gas to burn smokelessly.

9 Claims, 3 Drawing Figures

APPARATUS FOR INCINERATING WASTE GASES

The present invention relates to an apparatus for incinerating waste gases, and more particularly to an apparatus for incinerating flammable waste gases discharged from refineries, petrochemical plants, etc.

Apparatus for incinerating waste gases are already known which comprise a combustion furnace main body having a peripheral wall and a hearth and a plurality of flare burners disposed on the hearth. The flare burners include a burner main body having a peripheral wall and a bottom wall, a waste gas main pipe provided under the burner main body, waste gas branch pipes extending upward from the main pipe, and a nozzle mounted on the upper end of each of the branch pipes and positioned inside the peripheral wall of the burner main body. When burning a waste gas lighter than the atmospheric air, the conventional apparatus involve the following problems. In the event that the supply of waste gas to the flare burner spontaneously reduces and the combustion is automatically interrupted, or if the supply of waste gas to the flare burner is intentionally discontinued, the waste gas filling the branch pipe and main pipe gradually flows out from the nozzles because it is lighter than the air. Consequently, negative pressure is produced in the interior of the pipes, permitting air to reversely flow in and fill the pipes with a mixture of waste gas and air. Since the mixture is readily ignitable by the flame of pilot burner or the like, an explosion can take place. The explosion not only produces a great noise but also causes a backfire in the main pipe, possibly leading to the explosion of the plant itself connected thereto. It is therefore necessary to prevent the reverse flow of air into the branch pipes and main pipe. For this purpose, nitrogen or like inert gas in introduced into the branch pipes and main pipe upon detecting that the combustion of waste gas has been discontinued. The inert gas must be charged in an amount required to overcome the buoyancy of the waste gas. This necessitates large quantities of the inert gas, invariably rendering the equipment costly to maintain.

This invention provides an apparatus for incinerating waste gases which is free of the above problem. The apparatus comprises a combustion furnace main body having a peripheral wall and a hearth and a plurality of flare burners disposed on the hearth, each of the flare burners including a burner main body having a peripheral wall and a bottom wall, a waste gas main pipe provided under the burner main body, waste gas branch pipes extending upward from the main pipe and each having a vertical zigzag passage in an intermediate portion thereof, and gas nozzles mounted on the upper ends of the branch pipes respectively and positioned inside the peripheral wall of the burner main body. The zigzag passage included in the branch pipe prevents the reverse flow of air therethrough, eliminating the explosion which would otherwise result from the formation of a mixture of waste gas and air.

This invention will be described below in greater detail with reference to the accompanying drawings.

Figure 1:
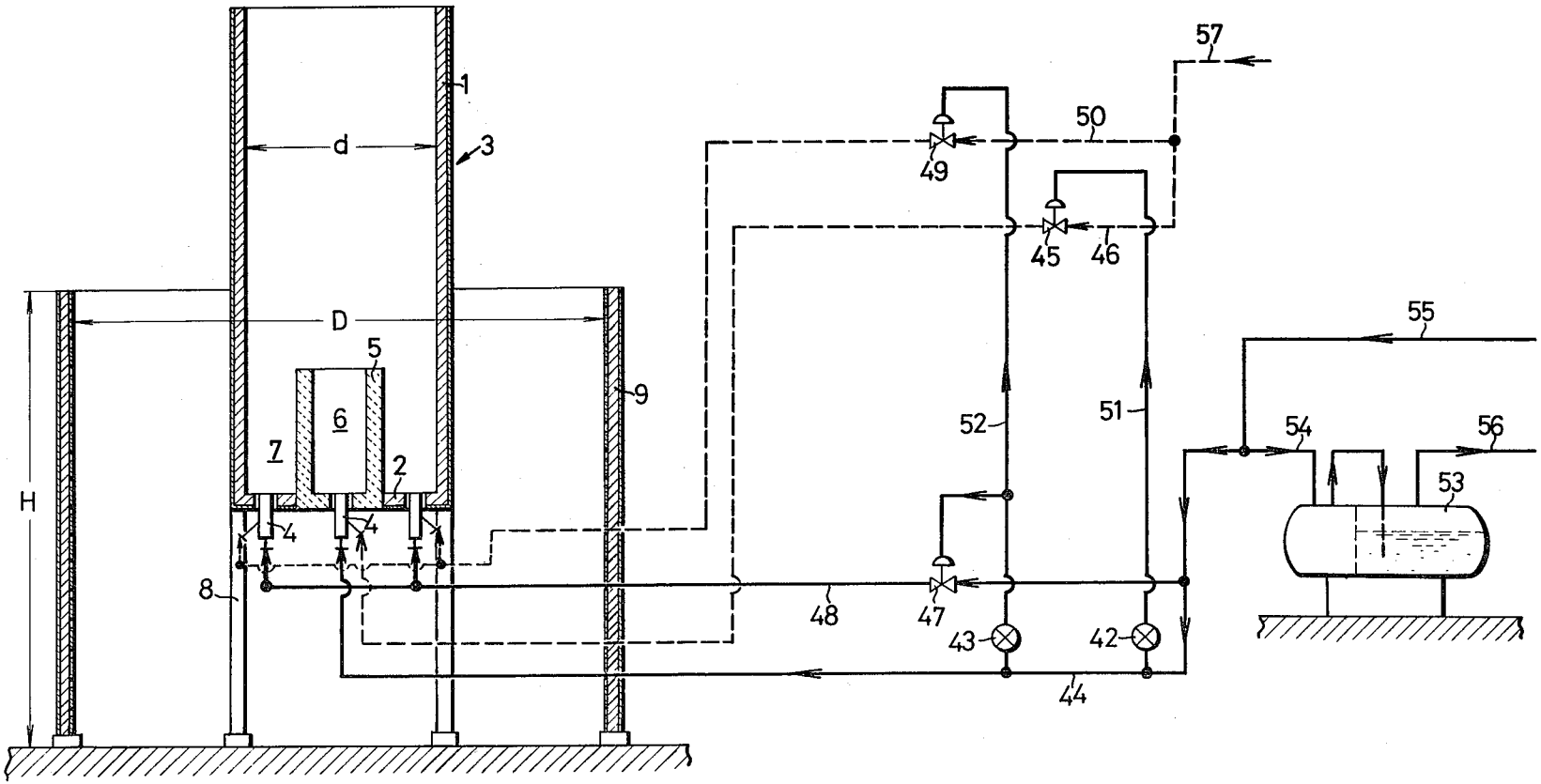
FIG. 1 is a diagram showing a waste gas incinerating apparatus of this invention in its entirety with its piping system schematically shown.

With reference to FIG. 1, a combustion furnace includes a main body 3 having a cylindrical peripheral wall 1 and a hearth 2, a plurality of flare burners 4 disposed on the hearth 2, and a combustion stabilizing tube 5 positioned upright on the hearth 2 at its center and surrounding a required number of the flare burners 4. The interior of the stabilizing tube 5 serves as an inner combustion chamber 6, while the space between the stabilizing tube 5 and the peripheral wall 1 of the combustion furnace main body 3 serves as an outer combustion chamber 7. The main body 3 is made of refractory bricks and covered with a steel sheet over the outer surface thereof. A refractory plastic material is usable in place of refractory bricks. The stabilizing tube 5 is also made of refractory bricks. Preferably, the stabilizing tube 5 has $\frac{1}{4}$ to $\frac{1}{2}$ the size of the main body 3. It is preferable to provide one to three flare burners 4 within the stabilizing tube 5. The main body 3 is supported by a plurality of posts 8. The lower portion of the main body 3 including the posts 8 is surrounded, at a specified spacing, by a cylindrical soundproof wall 9 made of a laminate of iron sheet, glass wool and porous board. Assuming that the inside diameter of the peripheral wall 1 is $d$, the inside diameter of the soundproof wall 9 is D and the height of the same is H, it is preferably that $D = 1.5d$ to $2.0d$ and $H = 0.5d$ to b $1.0d$. The soundproof wall 9 also provides protection against fire and wind. For soundproofing, it is preferable that the wall 9 have the greatest possible height and a small inside diameter so as to be positioned as close as possible to the main body 3. However, the reverse is preferable for the intake of combustion air. The above-mentioned ranges of the dimensions are determined as a compromise combining these contradictory relations together.

Figure 2:
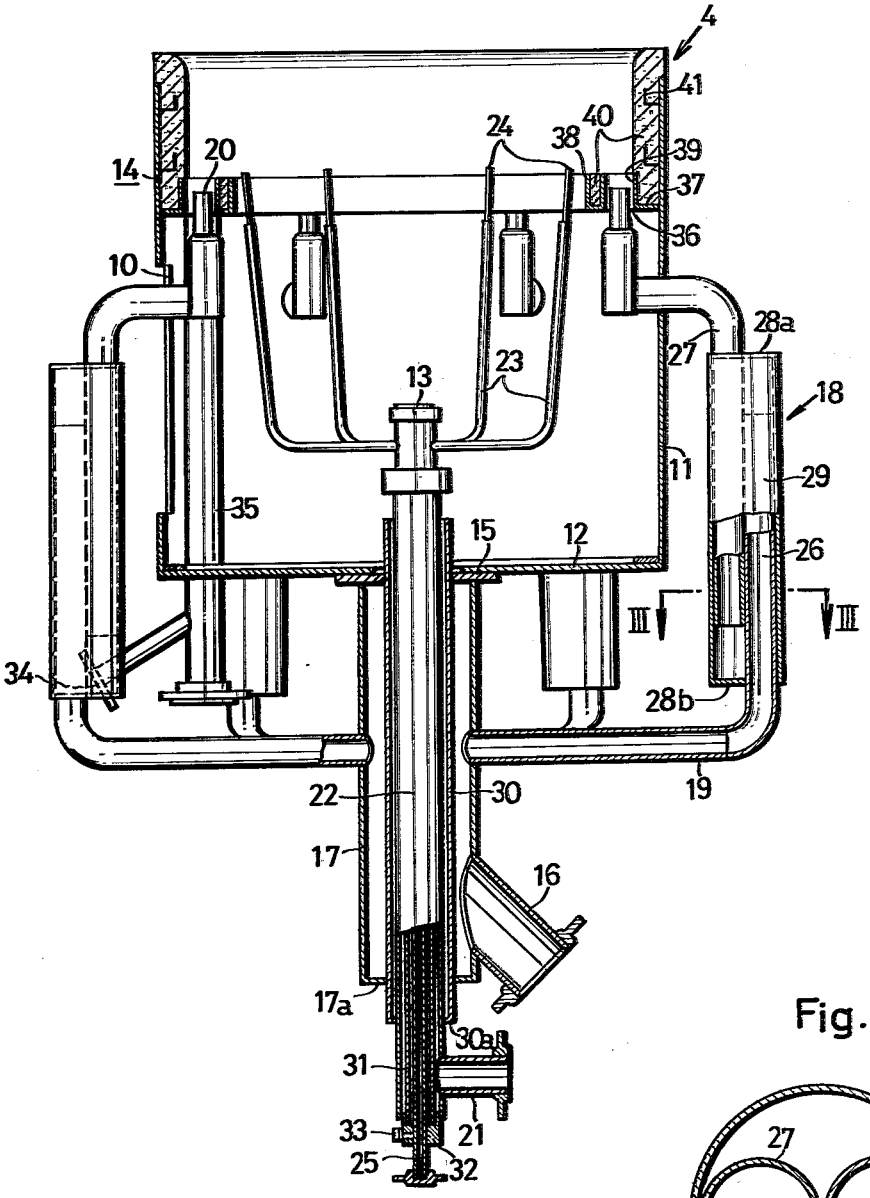
FIG. 2 is an enlarged view in vertical section showing a flare burner.

With reference to FIG. 2, the flare burner 4 includes a burner main body 14 having a cylindrical peripheral wall 11 formed with air intakes 10 at predetermined portions and a bottom wall 12; a waste gas main pipe 17 having a bottom and secured to the lower surface of the burner main body 14 with an annular plate 15 interposed therebetween, the main pipe 17 having an inlet 16 on its one side close to the lower end thereof; waste gas branch pipes 19 extending radially upward from the main pipe 17 and each having a vertical zigzag passage 18 in an intermediate portion thereof; gas nozzles 20 mounted on the upper ends of the branch pipes 19 respectively and positioned inside the peripheral wall 11 of the burner main body 14; a steam main pipe 22 extending through the waste gas main pipe 17 and projecting upward through the center of the bottom wall 12, the steam main pipe 22 having an inlet 21 on its one side close to the lower end thereof and having a closed upper end; steam branch pipes 23 extending radially upward from the steam main pipe 22 and equal in number to the waste gas branch pipes 19; steam nozzles 24 mounted on the upper ends of the steam branch pipes 23 respectively and positioned close to the gas nozzles 20; a water pipe 25 extending through the steam main pipe 22 and having a spray head 13 at its upper end.

Figure 3:
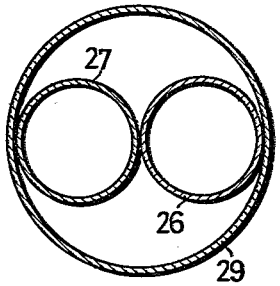
FIG. 3 is an enlarged view in section taken along the line III—III in FIG. 2.

With reference to FIGS. 2 and 3, the zigzag passage 18 is formed by an L-shaped upward pipe 26 communicating with the waste gas main pipe 17, an inverted L-shaped downward pipe 27 having an upper end extending into the burner main body 14 and communicating with the gas nozzle 20, the downward pipe 27 having a vertical portion disposed in parallel to the upward pipe 26 in lapping relation thereto, and a joint tube 29 enclosing the lapping portions of the pipes 26 and 27 and having upper and lower closing walls 28*a*, and 28*b*. A small space is provided between the upper end of the upward pipe 26 and the upper wall 28*a* and between the lower end of the downward pipe 27 and the lower wall 28*b*.

The steam main pipe 22 is secured to and supported by an inwardly projecting flange 30*a* at the lower end of a support tube 30 extending through the waste gas main pipe 17. The support tube 30 is secured to the annular bottom wall 17*a* of the waste gas main pipe 17 and to the annular plate 15 and has an upper end extending upward through the bottom wall 12 and a lower end extending downward through the bottom wall 17*a*. A pipe 31 encloses the water pipe 25 with a slight clearance provided therebetween. The lower ends of the steam main pipe 22 and the pipe 31 are closed with a plug 32. The water pipe 25 extending downward through the plug 32 is held in position by a screw 33 driven through one side of the plug 31. A pilot burner (not shown) disposed close to one of the gas nozzles 20 is mounted on the upper end of a gas pipe 35 extending through the bottom wall 12 of the burner main body 14 and having an inlet 34 at its one side close to the lower end thereof.

An inner flange 37 having bores 36 for accommodating the gas nozzles is formed on the peripheral wall 11 of the burner main body 14 at a position closer to its upper end. The flange 37 has an annular upstanding wall 38 on its inner periphery. A short tube 39 having the same height as the wall 38 is secured to the periphery of the bore 36. A refractory layer 40 is formed on the upper surface of the flange 37 up to the upper end of the wall 38. The same refractory layer 40 as above is also formed on the inside of the upper end of the peripheral wall 11. A number of anchors 41 embedded in the refractory layer 40 are provided at a specified spacing on the inner surface of the upper end of the peripheral wall 11. Although not fully shown in FIG. 1, 48 flare burners 4 having the foregoing construction are provided on the hearth 2, three of which are positioned within the inner combustion chamber 6.

When the combustion of the waste gas is interrupted due to a decrease in the waste gas supply, an explosive mixture of waste gas and air will not fill the waste gas branch pipes 19 and the waste gas main pipe 17 for the following reason. Upon interruption of combustion, the waste gas present in the waste gas branch pipes 19 and the waste gas main pipe 17 tends to flow out from the gas nozzles 20. In the zigzag passage 18 of each waste gas branch pipe 19, however, the waste gas flowing into the joint tube 29 from the upward pipe 26 is unable to move to the lower end of the joint tube 29 and remains at the upper end of the joint tube 29, since it is lighter than air. The waste gas within the joint tube 29 ascends and remains at the upper portion thereof. The waste gas within the downward pipe 27 gradually escapes through the nozzle 20, permitting air to flow in. The air, which is heavier than the waste gas, remains at the lower end of the joint tube 29 but does not flow upward to the upper end of the joint tube 29. Thus the air will not flow reversely through the branch pipe 19 into the waste gas main pipe 17.

The zigzag passage can of course be designed to have various constructions other than one shown in the drawings.

With reference to FIG. 1 again, a first waste gas duct 44 having first and second pressure detectors 42 and 43 is connected to the inlets 16 of the waste gas main pipes 17 for the inner combustion chamber 6. A first steam duct 46 having a valve 45 is connected to the inlets 21 of the steam main pipes 22 for the same chamber. A second waste gas duct 48 having a valve 47 and branching off from the first waste gas duct 44 is connected to the inlets 16 of the waste gas main pipes 17 for the outer combustion chamber 7, while a second steam duct 50 having a valve 49 and branching off from the first steam duct 46 is connected to the inlets 21 of the steam main pipes 22 for the same chamber. The first pressure detector 42 is electrically connected to the valve 45 on the first steam duct 46, and the second pressure detector 43 to the valve 47 on the second waste gas duct 48 and to the valve 49 on the second steam duct 50. The first pressure detector 42 is adapted to detect pressure exceeding zero. The second pressure detector 43 is set for valve opening at a higher value than the first pressure detector 42, such that when the waste gas is introduced into the first waste gas duct 44, the first pressure detector 42 first emits a signal 51 which opens the valve 45 on the first steam duct 46. Subsequently, the second pressure detector 43 emits a signal 52 which opens the valve 47 on the second waste gas duct 48 and the valve 49 on the second steam duct 50. The second pressure detector 43 is set for valve closing at a low value so that the valve 47 will not be closed upon a sudden reduction in the pressure within the first waste gas duct 44 when the valve 47 is opened.

A main waste gas duct 55 from a waste gas supply is branched into the first waste gas duct 44 and a waste gas duct 54 extending to a gas seal drum 53. Extending from the gas seal drum 53 is another waste gas duct 56 connected to some other burning device such as a flare stack, whereby when the waste gas is introduced into the main gas duct 55 at a rate exceeding the maximum treating capacity of the combustion furnace, the water seal within the gas seal drum 53 is broken, permitting the excess of the waste gas to be conducted to the burning device. The first steam duct 46 is connected to a main steam duct 57 from a steam supply. Although not shown, the water pipe 25 is connected to a water main having a manual valve. When the temperature within the combustion furnace rises to excess, water is admitted to the water pipe 25 and is injected into the burner main body 14 through the head 25*a*.

With reference to FIGS. 1 to 3, the waste gas, when admitted to the first waste gas duct 44 from the main waste gas duct 55, is detected by the first pressure detector 42 before reaching the flare burners 4, whereupon the valve 45 on the first steam duct 46 is opened, permitting steam to jet out from the steam nozzles 24 of the flare burners 4 within the inner combustion chamber 6 and simultaneously causing the resulting draft to introduce combustion air into the burner main body 14 through the air intakes 10. Subsequently, the waste gas jets out from the gas nozzles 20 and is burned on being ignited by a pilot burner which is lighted at all times. At this time, the free carbon in the flame and the steam forced out from the steam nozzles undergo water gas reaction, permitting the gas to burn free of smoke. While the waste gas flows through the first waste gas duct 44 at an increasing rate, the pressure of the gas reaches the value at which the second pressure detector 43 is set for valve opening, whereupon the valve 47 on the second waste gas duct 48 and the valve 49 on the second steam duct 50 are opened. As a result, combustion takes place with the flare burners 4 within the outer combustion chamber 7 in the same manner as above. If the waste gas supply through the first waste gas duct 44 reduces, with a pressure drop to a level not higher than the value at which the second pressure detector 41 is set for valve closing, the valves 47 and 49 are closed. In the flare burners 4, the steam jets out earlier than the waste gas, because the valves 45 and 49 on the steam ducts 46 and 50 are positioned much closer to the flare burners 4 than the first pressure detector 42 and the valve 47 on the second waste gas duct 48.

In the event that the waste gas supply exceeds the maximum capacity of the combustion furnace, the excess of the waste gas is led to another combustion device by way of the gas seal drum 53 and is thereby burned.

Although the waste gases are discharged from chemical plants and the like at greatly varying rates, the gas can be burned appropriately in accordance with the rate of supply by the inner combustion chamber 6 alone, or both the inner and outer combustion chambers 6 and 7, or the combustion furnace including the chambers 6 and 7 and another combustion device.

This invention may be embodied differently without departing from the spirit and basic features of the invention. Accordingly the embodiment herein disclosed is given for illustrative purposes only and is not in any way limitative. It is to be understood that the scope of this invention is defined by the appended claims rather than by the specification and that various alterations and modifications within the definition and scope of the claims are included in the claims.

What is claimed is:

1. An apparatus for incinerating a waste gas comprising a combustion furnace main body having a peripheral wall and a hearth and a plurality of flare burners disposed on the hearth, each of the flare burners including a burner main body having a peripheral wall and a bottom wall, a waste gas main pipe provided under the burner main body, waste gas branch pipes extending upward from the waste gas main pipe and each having a vertical zigzag passage in an intermediate portion thereof, and gas nozzles mounted on the upper ends of the waste gas branch pipes respectively and positioned inside the peripheral wall of the burner main body.

2. An apparatus as defined in claim 1 wherein the zigzag passage is formed by an upward pipe, a downward pipe communicating with the nozzle and disposed in parallel to the upward pipe in partially lapping relation thereto, and a joint tube enclosing the lapping portions of the pipes and having upper and lower closing walls, a small space being provided between the upper end of the upward pipe and the upper wall and between the lower end of the downward pipe and the lower wall.

3. An apparatus as defined in claim 1 further including a steam main pipe extending through the waste gas main pipe and projecting upward through the bottom wall of the burner main body, steam branch pipes extending upward from the steam main pipe, and steam nozzles mounted on the upper ends of the steam branch pipes respectively and positioned close to the gas nozzles.

4. An apparatus as defined in claim 1 wherein the combustion furnace main body is supported by a plurality of posts, and the lower portion of the combustion furnace main body including the posts is surrounded at a specified spacing by a soundproof wall.

5. An apparatus as defined in claim 4 wherein the peripheral wall of the combustion furnace main body and the soundproof wall are cylindrical and, when assuming that the inside diameter of the peripheral wall of the furnace is $d$, the inside diameter of the soundproof wall is D and the height of the same is H, $D = 1.5d$ to $2.0d$ and $H = 0.5d$ to $1.0d$.

6. An apparatus for incinerating a waste gas comprising a combustion furnace main body having a peripheral wall and a hearth, a plurality of flare burners disposed on the hearth, and a combustion stabilizing tube positioned upright on the hearth at its center and surrounding a required number of the flare burners, each of the flare burners including a burner main body having a peripheral wall and a bottom wall, a waste gas main pipe provided under the burner main body, waste gas branch pipes extending upward from the waste gas main pipe and each having a vertical zigzag passage in an intermediate portion thereof, gas nozzles mounted on the upper ends of the waste gas branch pipes respectively and positioned inside the peripheral wall of the burner main body, a steam main pipe extending through the waste gas main pipe and projecting upward through the bottom wall of the burner main body, steam branch pipes extending upward from the steam main pipe, and steam nozzles mounted on the upper ends of the steam branch pipes respectively and positioned close to the gas nozzles, the interior of the stabilizing tube serving as an inner combustion chamber, the space between the stabilizing tube and the peripheral wall of the combustion furnace serving an an outer combustion chamber.

7. An apparatus as defined in claim 6 wherein the combustion stabilizing tube is made of refractory bricks.

8. An apparatus as defined in claim 6 wherein the waste gas main pipes for the inner combustion chamber are connected to a first waste gas duct having first and second pressure detectors, the steam main pipes for the same chamber being connected to a first steam duct having a valve, the waste gas main pipes for the outer combustion chamber being connected to a second waste gas duct having a valve and branching off from the first waste gas duct, the steam main pipes for the same chamber being connected to a second steam duct having a valve and branching off from the first steam duct, the second pressure detector being set for valve opening at a higher value than the first pressure detector, whereby when the waste gas is introduced into the first waste gas duct, the first pressure detector first emits a signal which opens the valve on the first steam duct and the second pressure detector thereafter emits a signal which opens the valve on the second waste gas duct and the valve on the second steam duct.

9. An apparatus as defined in claim 8 wherein a main waste gas duct from a waste gas supply is branched into the first waste gas duct and a waste gas duct extending to a gas seal drum, and another waste gas duct extending from the gas seal drum is connected to another burning device, whereby when the waste gas is introduced into the main gas duct at a rate exceeding the maximum capacity of the combustion furnace, the water seal within the gas seal drum is broken, permitting the excess of the waste gas to flow into said another burning device.

* * * * *